United States Patent [19]

Gongwer

[11] Patent Number: 4,735,045

[45] Date of Patent: Apr. 5, 1988

[54] LIMITED DISCHARGE BIDIRECTIONAL THRUSTER AND METHOD OF OPERATION

[75] Inventor: Calvin A. Gongwer, Glendora, Calif.

[73] Assignee: Innerspace Corporation, Glendora, Calif.

[21] Appl. No.: 894,760

[22] Filed: Aug. 13, 1986

Related U.S. Application Data

[63] Continuation of Ser. No. 472,131, Mar. 4, 1983, abandoned, which is a continuation-in-part of Ser. No. 267,993, May 28, 1981, abandoned.

[51] Int. Cl.[4] ..... B63H 11/00

[52] U.S. Cl. ..... 60/204; 60/221; 915/147; 440/38

[58] Field of Search ..... 60/204, 221, 222; 415/121 G, 147, 157; 114/151; 440/38, 39, 40, 43, 46

[56] References Cited

U.S. PATENT DOCUMENTS

| | | | |
|---|---|---|---|
| 933,681 | 9/1909 | Valk | 415/147 |
| 1,700,913 | 2/1929 | Tawara | 60/221 |
| 2,154,321 | 4/1939 | Briggs | 114/151 |
| 2,430,225 | 11/1947 | Hayler | 415/157 |
| 2,459,815 | 1/1949 | Hammell | 415/147 |
| 3,416,454 | 12/1968 | Dowdican | 415/147 |
| 3,483,824 | 12/1969 | Sprague | 415/147 |
| 3,590,766 | 7/1971 | Jackson | 114/151 |
| 3,593,686 | 8/1969 | Cooper | 114/151 |
| 3,598,078 | 8/1971 | Baer | 114/151 |
| 3,809,492 | 5/1974 | Takaeda et al. | 415/121 G |
| 3,903,833 | 9/1975 | Lais et al. | 114/151 |
| 4,057,961 | 11/1977 | Payne | 60/221 |

FOREIGN PATENT DOCUMENTS

| | | | |
|---|---|---|---|
| 1210352 | 2/1966 | Fed. Rep. of Germany | 114/151 |
| 2438305 | 4/1975 | Fed. Rep. of Germany | 114/151 |
| 64869 | 12/1949 | Netherlands | 114/151 |
| 650271 | 2/1951 | United Kingdom | 440/46 |

*Primary Examiner*—Louis J. Casaregola
*Attorney, Agent, or Firm*—Lyon & Lyon

[57] ABSTRACT

A thruster for use underwater having a rotor which may be optionally rotated either clockwise or counterclockwise. The rotor includes blading, perferably radially symmetrical about the rotor radius line, and a limited discharge area such that fluid is discharged from said limited discharge in a direction substantially perpendicular to a rotor radius line passing through the approximate center of the limited discharge area.

7 Claims, 1 Drawing Sheet

LIMITED DISCHARGE BIDIRECTIONAL THRUSTER AND METHOD OF OPERATION

This is a continuation of application Ser. No. 472,131, filed Mar. 4, 1983, now abandoned, which is a continuation-in-part of application Ser. No. 267,993, filed May 28, 1981, now abandoned.

BRIEF DESCRIPTION OF THE INVENTION

1. Field of the Invention

This invention relates to a limited discharge bidirectional thruster. In particular, the present invention is directed to a thruster and its underwater operation wherein the fluid thrust is imparted by fluid discharge through a limited discharge area and the direction of the thrust is dependent on the direction of rotation of the rotor.

2. Description of the Prior Art

The prior art includes my U.S. Letters Pat. 4,055,947, Hydraulic Thruster, granted Nov. 1, 1977 and my U.S. Letter Patent 4,137,709, and 4,213,736, both titled Turbomachinery and Method of Operation, granted Feb. 6, 1979 and July 22, 1980, respectively. The basic design relationship for turbomachinery is defined by the Euler turbine equation, a form of Newton's laws of motion applied to fluid traversing a rotor, see generally, Shepard, Principles of Turbomachinery, Energy Transfer Between a Fluid and a Rotor (Macmillian Co. 1965).

DESCRIPTION OF PREFERRED EMBODIMENTS

Figure 1:
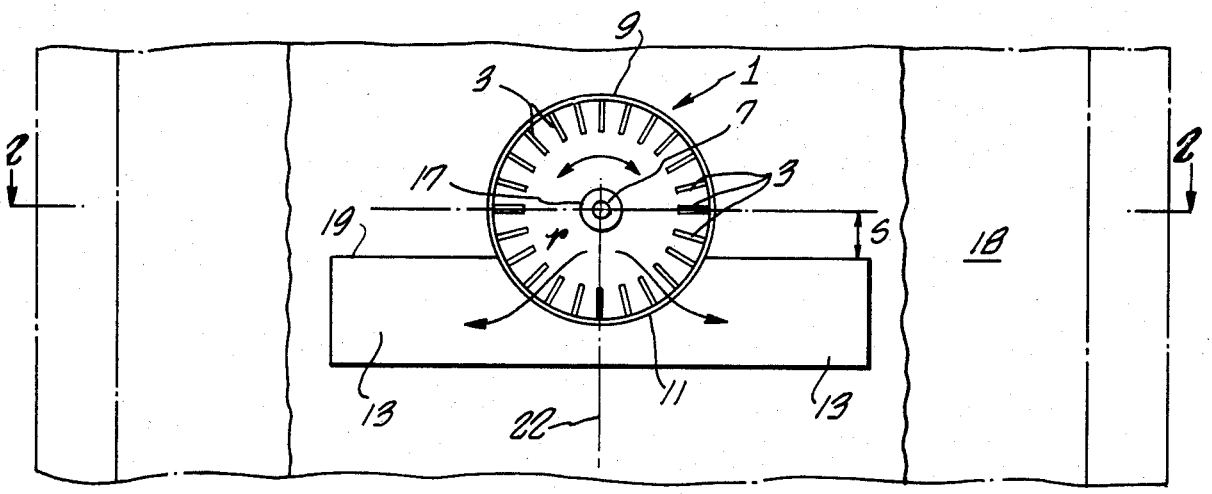
FIG. 1 is a cross-sectional view of the present invention.

Referring to FIG. 1, a thruster, referred to generally as 1, is shown. The thruster 1 includes a plurality of blades 3 at the exterior of the thruster rotor 5. Each of the thruster blades 3 is preferably substantially symmetrical about a radius line extending from the center of the rotor shaft 7. Radial blading is preferred because it allows for the thruster to provide equal thrust in opposed directions as well be discussed later in this description.

A thruster housing 9 is positioned about a first portion of the periphery of said radial blading 3. The second portion of the periphery of the blading 3 is open to a limited discharge area 11. Preferably the limited discharge area 11 includes an exterior relief channel 13 for ready exit of fluid from the radial blading 3 as the radial blading 3 rotates into position opposite the limited discharge area 11. The channel 13, as shown most particularly in FIG. 1, is preferably symmetrical about the limited discharge area 11 for the ready exit of fluid in a direction substantially perpendicular to a radial line extending from the center of the rotor shaft 7 through the center of the radial blading periphery adjacent the limited discharge area 11.

The spacing "s" between the center of rotor 5 and the wall 19 of the relief channel 13 is between 0 and 4/5 "r", the radius of the rotor 5.

The rotor 5 is driven by a motor 15 having a motor drive shaft 17 which operatively engages the rotor shaft 7. The thruster 1 is preferably mounted flush with the face of a ship bottom 18 such that the thruster inlet 20, preferably open and unlimited, is in direct contact with the fluid through which the ship is to pass.

Figure 3:
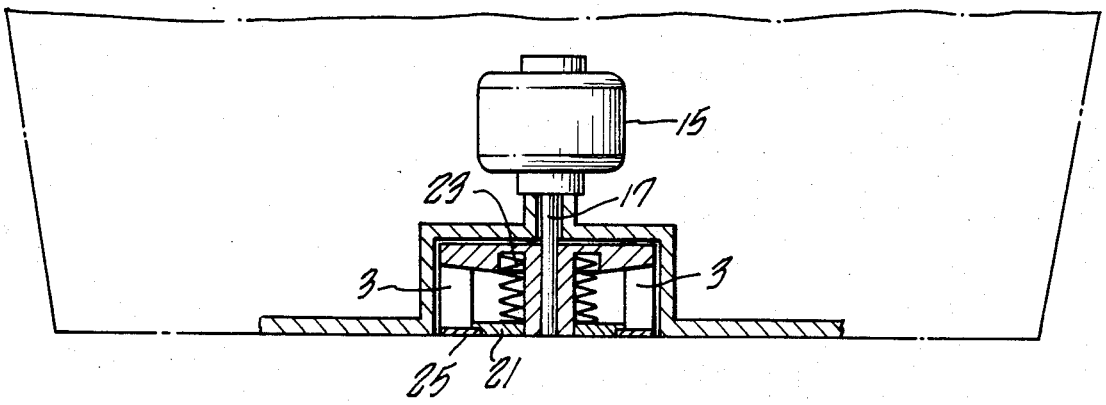
FIG. 3 is a cross-sectional view taken about 2—2 of FIG. 1.

An annular protective cover 21 is biased by a biasing means 23, preferably a spring, toward the closed position as shown in FIG. 3 where the protective cover 21 cooperates with annular end disc 25 so as to seal the thruster inlet.

The thruster of this invention having been described in detail, its method of operation will now be discussed. Incoming fluid enters the thruster 1 at the thruster inlet 20 and is spun about the rotor shaft 7 as the rotor 5 is turned by drive 15. The thruster housing 9 is positioned about, and in close proximity to, a first portion of the radial blading 3 of the rotor 5. The thruster housing 9 prevents exit of fluid from the radial blading 3 except at the limited discharge area 11. Referring to FIG. 1, when the rotor 5 is rotated in the clockwise direction the fluid is discharged through the limited discharge area 11 and toward the left through channel 13 in a direction substantially perpendicular to a line 22 from the center of the rotor shaft 7 through the approximate center of that portion of the periphery of the radial blading 3 open to the limited discharge area 11. When it is desired to produce a thrust toward the left as shown in FIG. 1, with corresponding fluid flow toward the right through channel 13, the rotation of the rotor shaft 7 is reversed to the counterclockwise direction and fluid is discharged through the limited discharge area 11 and toward the right through channel 13 in a direction substantially perpendicular to line 22 extending from the center of the rotor shaft 7 through the approximate center of the periphery of the radial blading 3 open to the limited discharge area 11.

Figure 2:
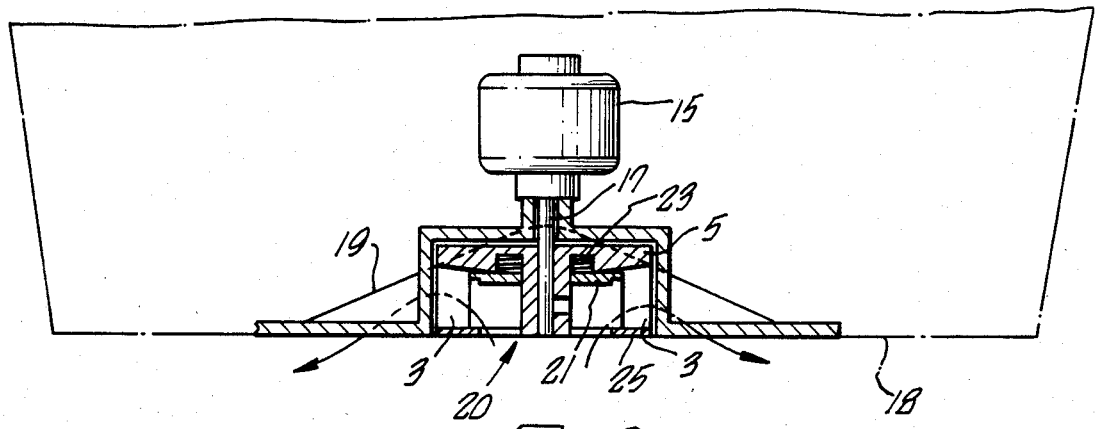
FIG. 2 is a cross-sectional view taken about 2—2 of FIG. 1.

When the thruster is operated, fluid flows into the thruster thereby overcoming the biasing means 23 force executed on protective cover 21 and forcing the protective cover 21 and the biasing means to the position shown in FIG. 2.

Having described this invention and its preferred embodiments in detail, it is understood that certain modifications may be made by those skilled in the art without departing from the scope of the apended claims which follow.

What is claimed is:

1. A bidirectional thruster comprising:

a rotatable rotor;

a plurality of thruster blades disposed about the exterior of said rotor;

a thruster housing positioned about, and in close proximity to a first portion of the periphery of the radial blading;

a thruster inlet concentric with said rotor;

a biased annular protective cover positioned coaxial with said rotor; said annular protective cover being biased toward the closed position, sealing said thruster inlet when said thruster is idle; the biasing force has a value less than the force of the incoming water allowing said annular protective cover to be forced open when said thruster is operating, and a limited discharge area adjacent and in fluid communication with a second portion of the periphery of said radial blading.

2. The thruster claimed in claim 1 wherein said limited discharge area is more fully defined as including an exterior relief channel for ready exit of fluid in a direction substantially perpendicular to a line from the center of the rotor shaft through the approximate center of said second portion of the periphery of said radial blading, and said exterior relief channel is located a distance from the center of said rotor in the range between 0 and 4/5r; where r is the radius of the rotor.

3. The thruster claimed in claim 1 wherein said blading is more fully defined wherein each of said blades is substantially symmetrical in cross section along its radial axis parallel to a radius line extending from the center of said rotor shaft.

4. A bidirectional thruster comprising:

a rotor adapted to rotate optionally in either the clockwise or counterclockwise direction;

a plurality of radial thruster blades disposed about the exterior of said rotor, each of said blades being substantially symmetrical in cross section along its radial axis parallel to a radius line extending from the center of said rotor shaft;

a thruster housing positioned about, and in close proximity to, a first portion of the periphery of said radial blading;

a thruster inlet concentric with said rotor;

an annular end disc attached to the periphery of said thruster housing at said thruster inlet;

a biased annular protective cover positioned within said housing and coaxial with said rotor; said biased annular cover being biased toward the closed position; when said thruster is idle said biased annular protective cover contacts said annular end disc sealing said thruster inlet; the biasing force has a value less than that of the force of the incoming water allowing said annular protective cover to be forced away from said annular end disc when said thruster is operating; and a limited discharge area including an exterior relief channel for ready exit of fluid in a direction substantially perpendicular to a line from the center of the rotor shaft through the approximate center of a second portion of the periphery of said radial blading in fluid communication with said limited discharge area.

5. A method of thruster operation comprising:

causing fluid to enter a rotor inlet;

rotating a thruster rotor having a plurality of radial thruster blades disposed about the exterior of said rotor, each of said blades being substantially symmetrical about the center of said rotor shaft;

forcing an annular protective cover biased in the closed position into an open position away from the thruster inlet thereby allowing fluid to enter the thruster through the thruster inlet; and discharging said fluid through said radial blading into a limited discharge area which is in fluid communication with a portion of the periphery of said radial blading as said rotating radial blades come into position opposite said limited discharge area.

6. The method claimed in claim 5 wherein said limited discharge area is more fully defined as including an exterior relief channel for ready exiting of fluid in a direction substantially perpendicular to a line from the center of the rotor through the approximate center of the periphery of said radial blading in communication with said discharge area.

7. The method claimed in claim 6 wherein said rotating of said rotor is optionally either clockwise or counterclockwise.

* * * * *